US008074981B2

(12) United States Patent
Shih et al.

(10) Patent No.: US 8,074,981 B2
(45) Date of Patent: Dec. 13, 2011

(54) PAPER HOLDING DEVICE AND PRINTER WITH PAPER HOLDING DEVICE

(75) Inventors: Chih-Kun Shih, Santa Clara, CA (US); Chun-Hsien Lin, Taipei Hsien (TW); Chen-Lu Fan, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/791,035

(22) Filed: Jun. 1, 2010

(65) Prior Publication Data

US 2011/0148032 A1 Jun. 23, 2011

(30) Foreign Application Priority Data

Dec. 17, 2009 (CN) ..... 2009 1 0311742

(51) Int. Cl.
*B65H 1/00* (2006.01)

(52) U.S. Cl. ..... 271/171; 271/223; 271/224

(58) Field of Classification Search ..... 271/223, 271/224, 171
See application file for complete search history.

(56) References Cited

U.S. PATENT DOCUMENTS

| | | | | |
|---|---|---|---|---|
| 3,921,972 | A * | 11/1975 | Miller | 271/171 |
| 5,172,903 | A * | 12/1992 | Haneda et al. | 271/171 |
| 6,073,925 | A * | 6/2000 | Sato | 271/171 |
| 6,196,539 | B1 * | 3/2001 | Lee | 271/171 |
| 6,471,206 | B1 * | 10/2002 | Spina et al. | 271/223 |
| 6,536,760 | B1 * | 3/2003 | Spina et al. | 271/207 |
| 6,543,761 | B2 * | 4/2003 | Endo | 271/110 |
| 6,688,592 | B1 * | 2/2004 | Tan et al. | 271/171 |
| 6,893,015 | B2 * | 5/2005 | Tan et al. | 271/171 |
| 7,654,518 | B2 * | 2/2010 | Kim et al. | 271/171 |

* cited by examiner

*Primary Examiner* — Kaitlin Joerger
(74) *Attorney, Agent, or Firm* — Altis Law Group, Inc.

(57) ABSTRACT

A printer includes a main body and a paper holding device. The main body is capable of printing and outputting paper. The paper holding device is secured to the main body and includes a paper tray, a connecting mechanism, and a sliding mechanism. The paper tray is configured for receiving the outputted paper. A driving gear member is located on the paper tray. The connecting mechanism is located on the paper tray and connected to the driving gear member. The sliding mechanism is located on the paper tray and connected to the connecting mechanism. The driving gear member controls the sliding mechanism by the connecting mechanism to shape a space to fit the size of the outputted paper.

20 Claims, 7 Drawing Sheets

PAPER HOLDING DEVICE AND PRINTER WITH PAPER HOLDING DEVICE

BACKGROUND

This application is related to copending application entitled, "PRINTER WITH PAPER HOLDING DEVICE", filed on 2010 May 14, application Ser. No. 12/780,848.

1. Technical Field

The present disclosure relates to a paper holding device for receiving outputted paper and a printer with the paper holding device.

2. Description of Related Art

Many printers include a paper tray. However, when the printed sheet is deposited into the paper tray after printing, the sheets of paper may not be neatly stacked on top of each other because the sides of the sheets are misaligned. The stack of sheets must be taken out of the paper tray and aligned manually by a user. This is an inconvenience.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
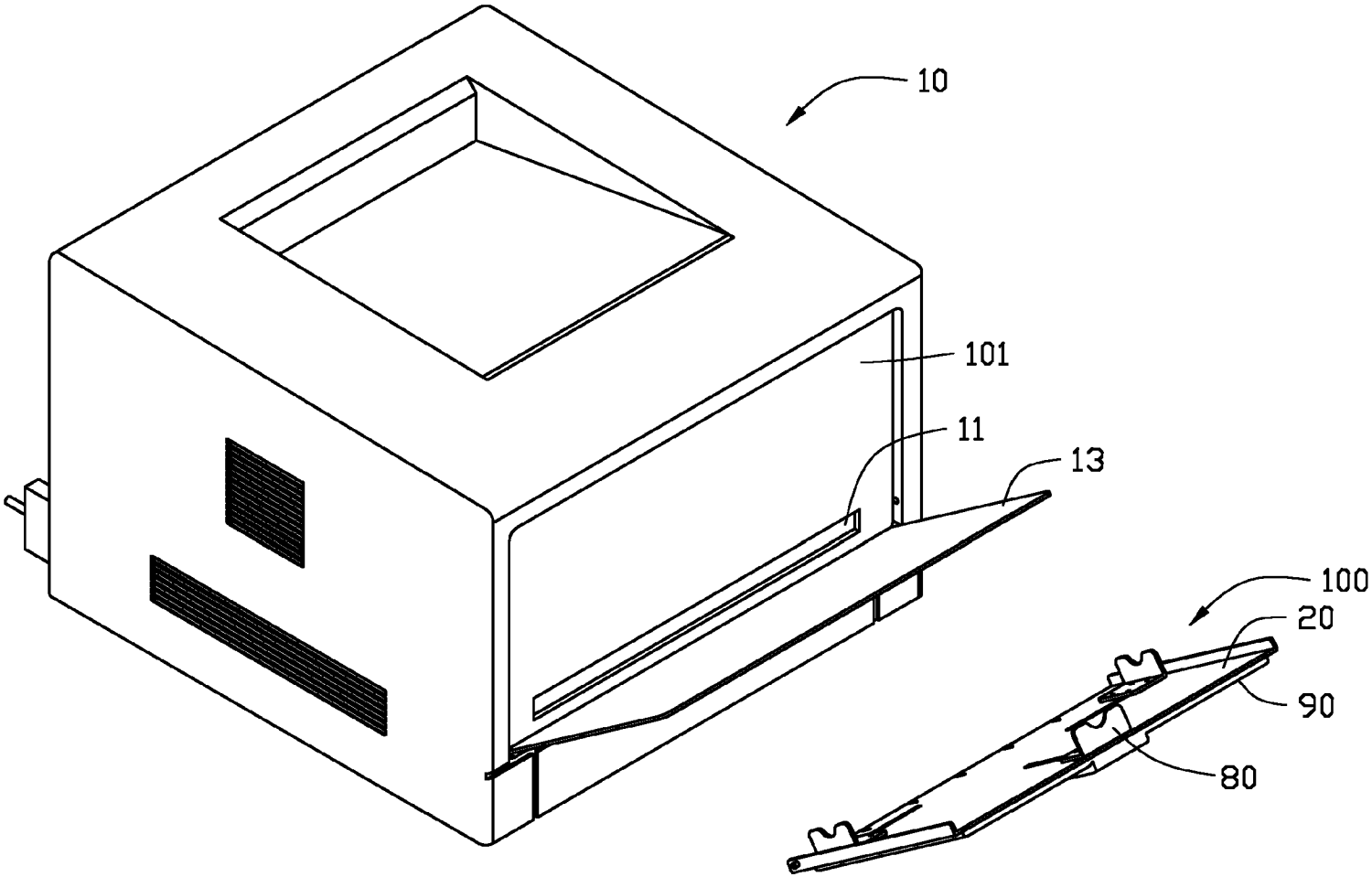
FIG. 1 is a partially exploded view of a printer in accordance with one embodiment.

Referring to FIG. 1, a printer in accordance with one embodiment includes a main body 10 and a paper holding device 100.

The main body 10 is capable of printing documents on paper and outputting the paper through an opening 11 defined in a rear wall 101 thereof. A supporting plate 13 is secured to the rear wall 101 below the through opening 11.

Figure 2:
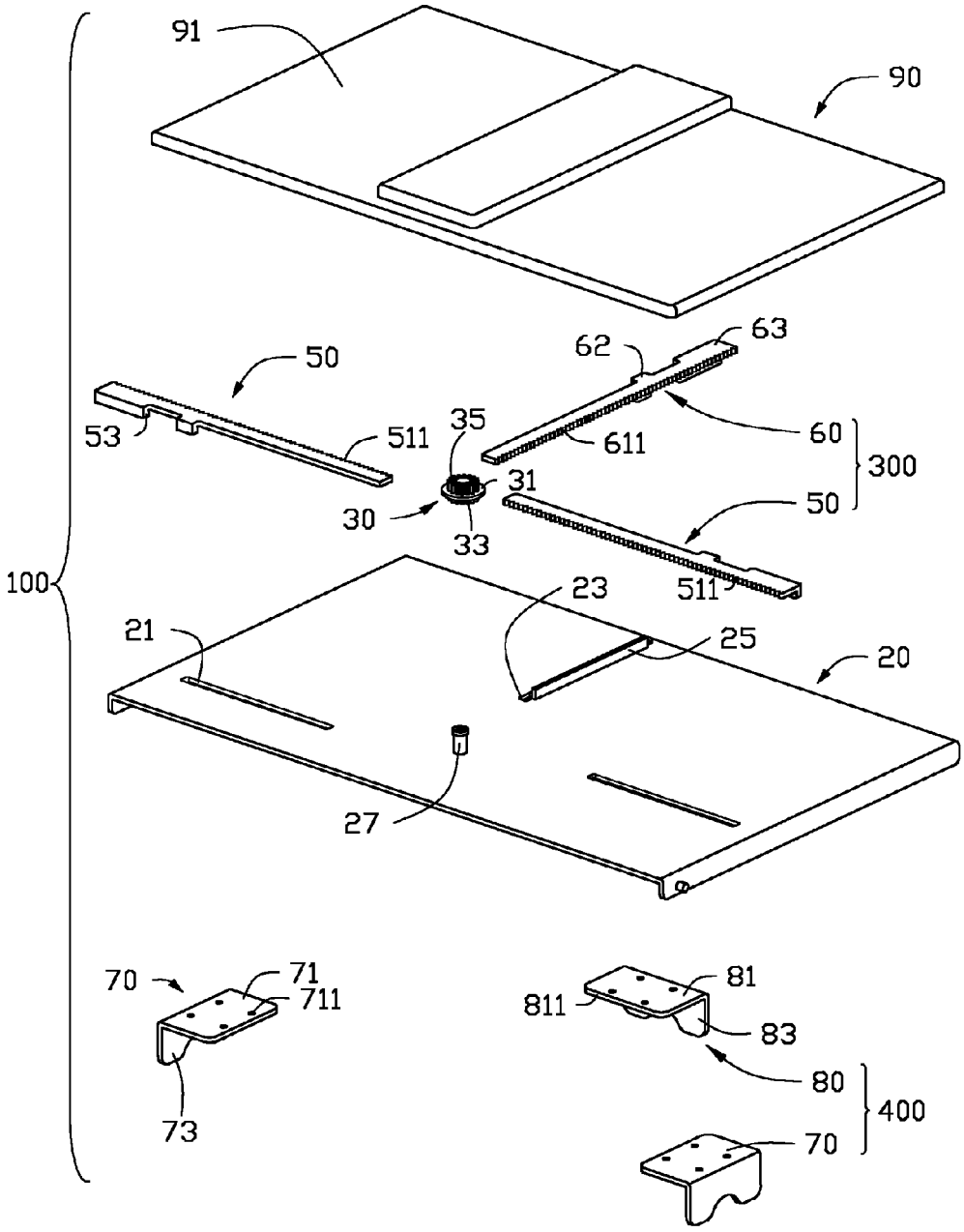
FIG. 2 is an exploded view of a paper holding device of FIG. 1.

Referring to FIG. 2, the paper holding device 100 is configured to be secured to the rear wall 101 of the main body 10 and includes a paper tray 20, a connecting mechanism 300, a sliding mechanism 400, and a cover 90.

The paper tray 20 defines two first sliding slots 21 and a second sliding slot 23. In one embodiment, the first sliding slots 21 extend in a first direction, the second sliding slot 23 extends in a second direction, and the first direction is perpendicular to the second direction. A flange 25 is located on a bottom surface of the paper tray 20, along an edge of the second slot 23. A positioning post 27 is located on the bottom surface of the paper tray 20 among the first sliding slots 21 and the second sliding slot 23.

A driving gear member 30 is configured to be secured to the positioning post 27. The driving gear member 30 can be rotated when the printed paper is output to the paper tray 20. In one embodiment, the driving gear member 30 includes a connecting portion 31, a top gear portion 33, and a bottom gear portion 35. The top gear portion 33 and the bottom gear portion 35 are located on opposite sides of the connecting portion 31.

The connecting mechanism 300 is attachable to the bottom surface of the paper tray 20 and includes two first gear members 50 and a second gear member 60. The first gear members 50 and the second gear member are capable of meshing with the driving gear member 30. In one embodiment, the first gear members 50 are substantially perpendicular to the second gear member 60. Each of the first gear members 50 includes a first gear portion 511 at one elongated edge thereof, for meshing with the driving gear member 30. A first limiting block 52 and a first sliding block 53 are located on each first gear member 50 and are both capable of sliding in the first sliding slots 21. A plurality of first mounting holes 531 is defined in each first sliding block 53. The second gear member 60 includes a second gear portion 611 at one elongated edge thereof, for meshing with the driving gear member 30. A second limiting block 62 and a second sliding block 63 are located on the second gear member 60 and are both capable of sliding in the second sliding slot 23. A plurality of second mounting holes 631 is defined in the second sliding block 63. In one embodiment, the first gear portions 511 of the first gear members 50 are configured to mesh with the top gear portion 33 of the driving gear member 30, and the second gear portion 611 of the second gear member 60 is configured to mesh with the bottom gear portion 35.

Figure 3:
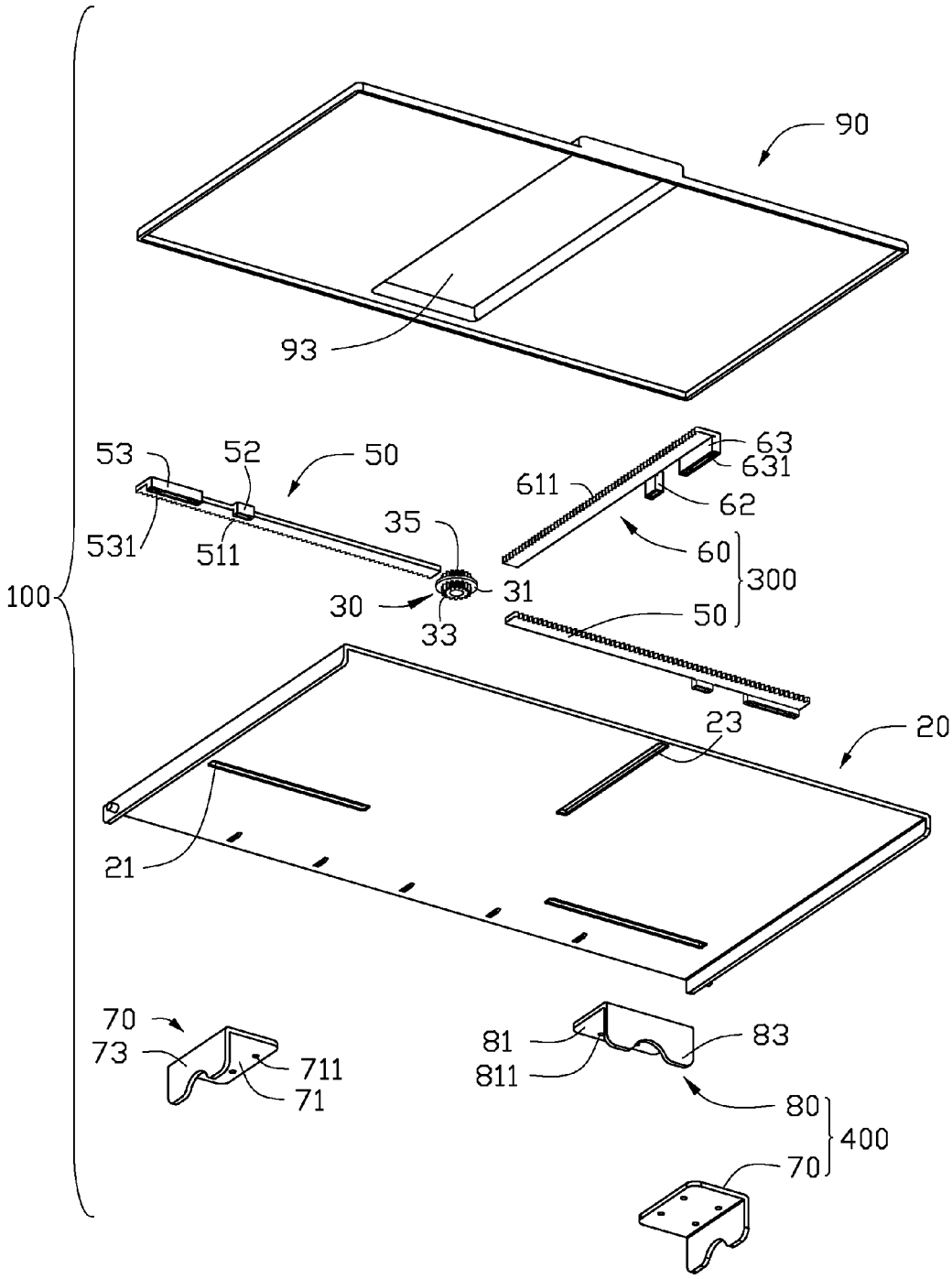
FIG. 3 is similar to FIG. 2, but viewed in a different aspect.
Figure 4:
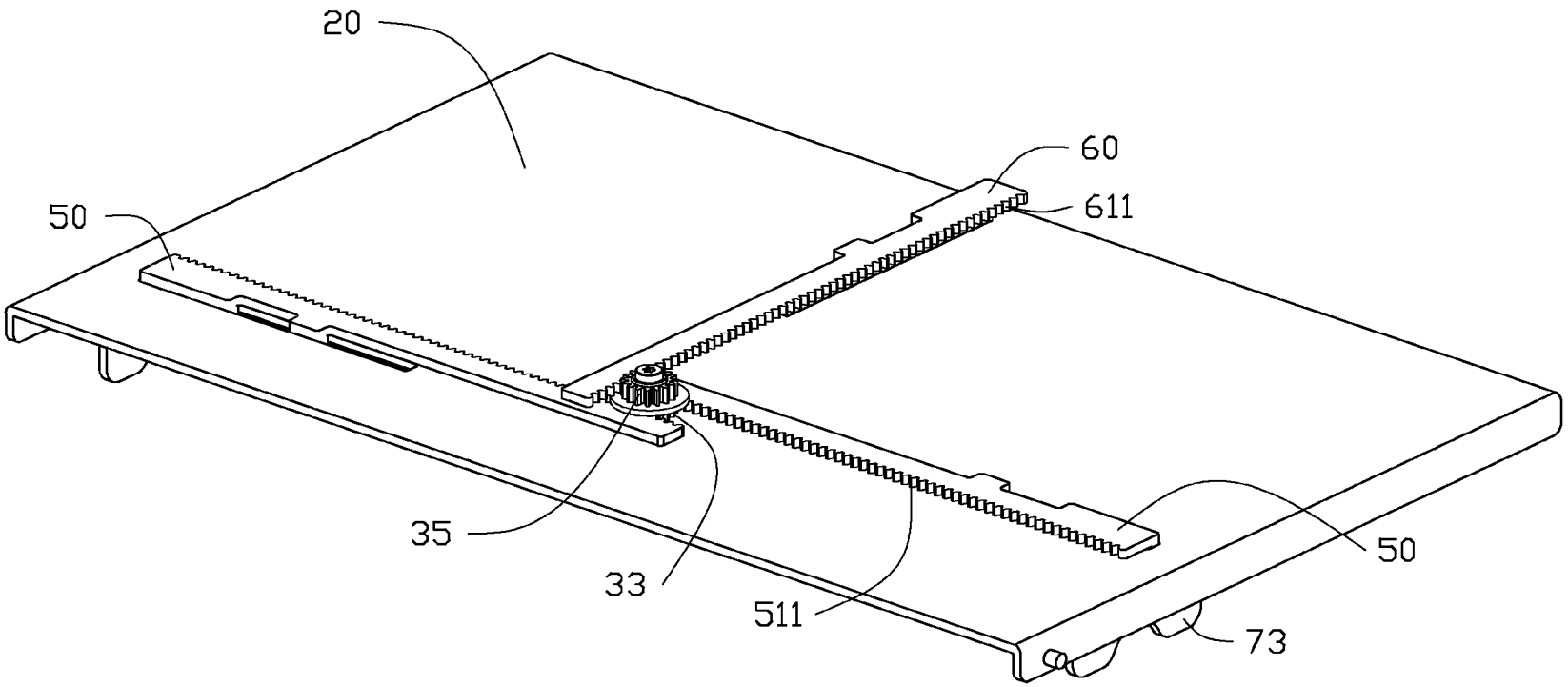
FIG. 4 is an assembled view of the paper holding device of FIG. 2, but the cover is not shown.
Figure 5:
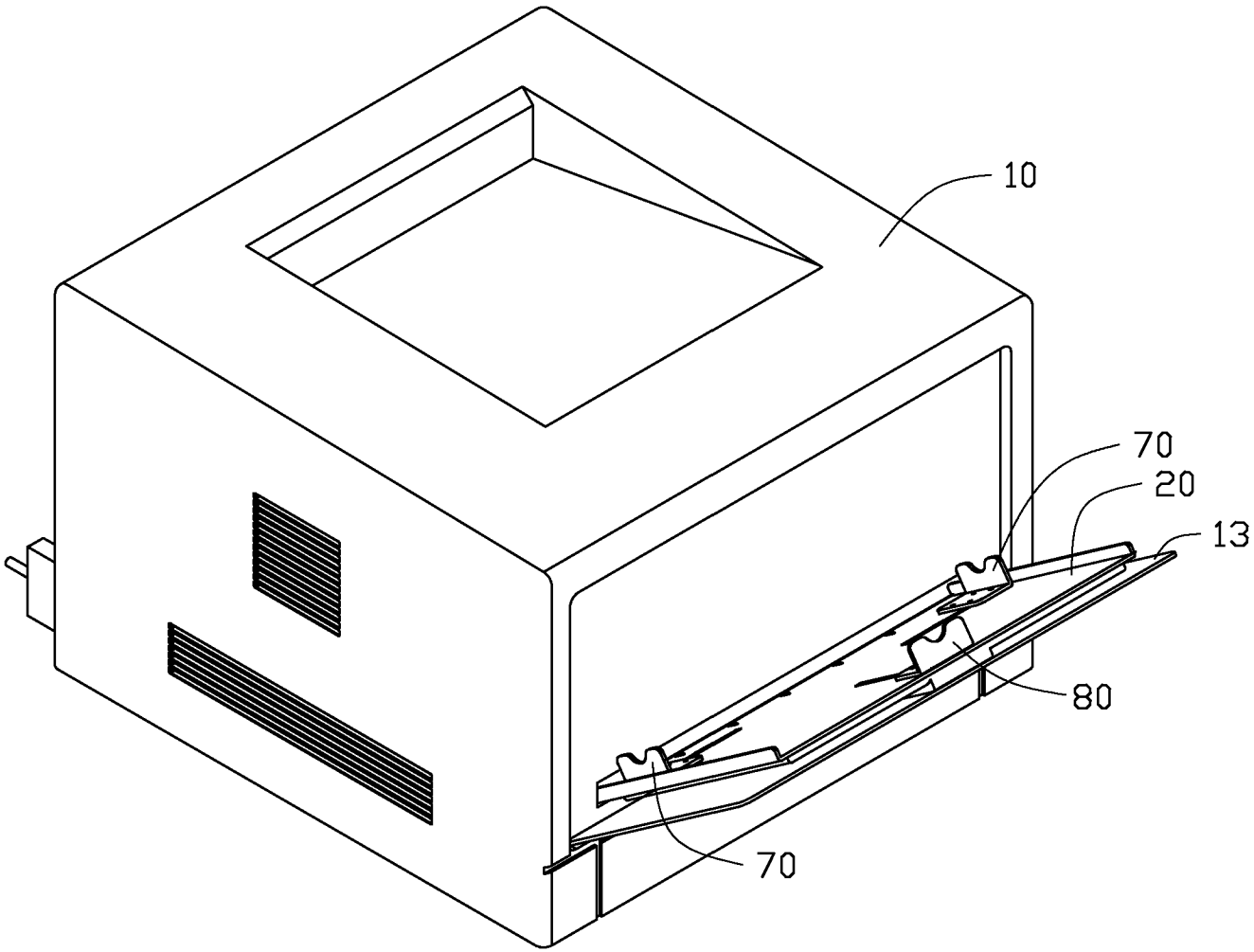
FIG. 5 is an assembled view of the printer of FIG. 1.

Referring to FIGS. 2-3, the sliding mechanism 400 includes two first sliding members 70 and a second sliding member 80. The first sliding members 70 are configured to be secured to the first sliding gear members 50, and each first sliding member 70 includes a first securing portion 71 and a first blocking portion 73 located on the first securing portion 71. A plurality of first securing holes 711 is defined in the securing portion 71. The second sliding member 80 includes a second securing portion 81 and a second blocking portion 83 located on the second securing portion 81. A plurality of second securing holes 811 is defined in the second securing portion 81. In one embodiment, the first blocking portion 73 is substantially perpendicular to the first securing portion 71, and the second blocking portion 83 is substantially perpendicular to the second securing portion 81.

The cover 90 is securable to the bottom surface of the paper tray 20 to cover the connecting mechanism 300 and the driving gear member 30. A recess 93 is defined in the cover 90 for receiving the driving gear member 30.

Referring also to FIGS. 2-5, in assembly, the driving gear member 30 is secured to the positioning post 27 of the paper tray 20. The first gear members 50 are placed on the bottom surface of the paper tray 20, and the second gear member 60 is located on the bottom surface of the paper tray 20 and abuts the flange 25. The first gear members 50 and the second gear member 60 mesh with the driving gear member 30. The first limiting blocks 52 and the first sliding blocks 53 of the first gear members 50 are respectively inserted in the first sliding slots 21, and the second limiting block 62 and the second sliding block 63 of the second gear member 60 are inserted in the second sliding slot 23. The first sliding members 70 and the second sliding member 80 are placed on a top surface of the paper tray 20. The first sliding members 70 are positioned above the first sliding slots 21, and the first securing holes 711 correspond to the first mounting holes 531 of the first sliding blocks 53 of the first gear members 50. The second sliding member 80 is positioned above the second sliding slot 23, and the second securing holes 811 correspond to the second mounting holes 631. A plurality of first fasteners (not shown), such as screws, is engaged in the first securing holes 711 and the first mounting holes 531, to secure the first sliding members 70 to the first sliding blocks 53. A plurality of second fasteners (not shown), such as screws, is engaged in the second securing holes 811 and the second mounting holes 631, to secure the second sliding member 80 to the second sliding blocks 63. The cover 90 is secured to the bottom surface of the paper tray 20, to cover the connecting mechanism 300 and the driving gear member 30.

Figure 6:
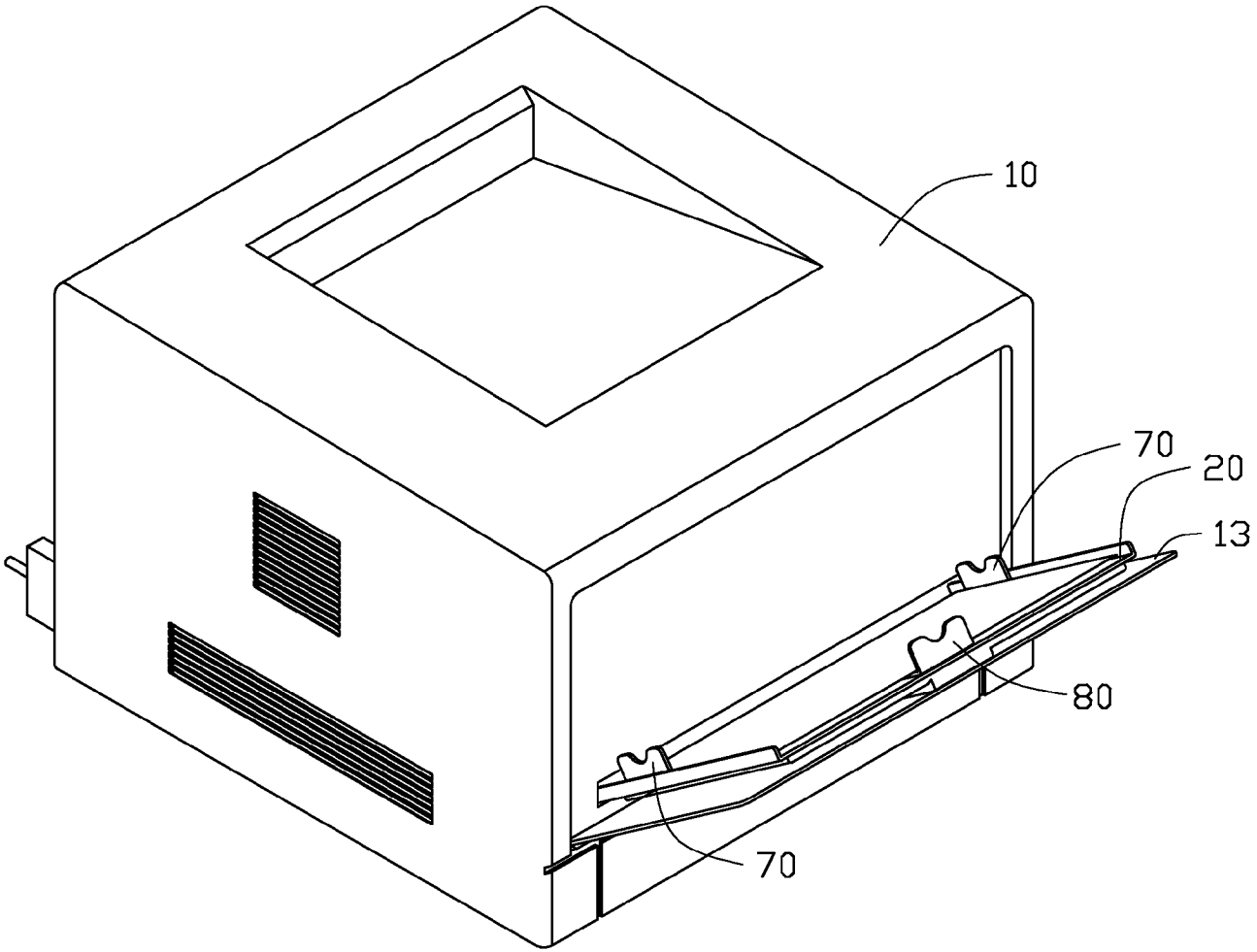
FIG. 6 is similar to FIG. 5, showing a paper positioned on the paper tray and the first and second sliding members in a first position.

Referring also to FIG. 6, when documents are printed by the main body 10 and printed paper having a first size is output from the opening 11, the first size of the outputted paper is detected by a main body 10 or a sensor (not shown) located on the main body 10 or the paper holding device 100, and the driving gear member 30 is controlled by the main body 10 or the sensor to rotate. Rotation of the driving gear 30 can synchronously slide the first gear members 50 and the second gear member 60. The first gear members 50 are slid in opposite directions, and the second gear member 60 is slid in a direction perpendicular to the opposite directions. The first sliding blocks 53 and the first limiting blocks 52 along with the first gear members 50 are slid in the first sliding slots 21, and the second sliding block 63 and the second limiting block 62 along with the second gear member 60 are slid in the second sliding slot 23. The first sliding members 70 and the second sliding member 80 are thereby slid on the top surface of the paper tray 20, to shape a first space to fit the first size of the outputted paper and cause the outputted paper to precisely stack in a neat orderly stack on the paper tray 20.

Figure 7:
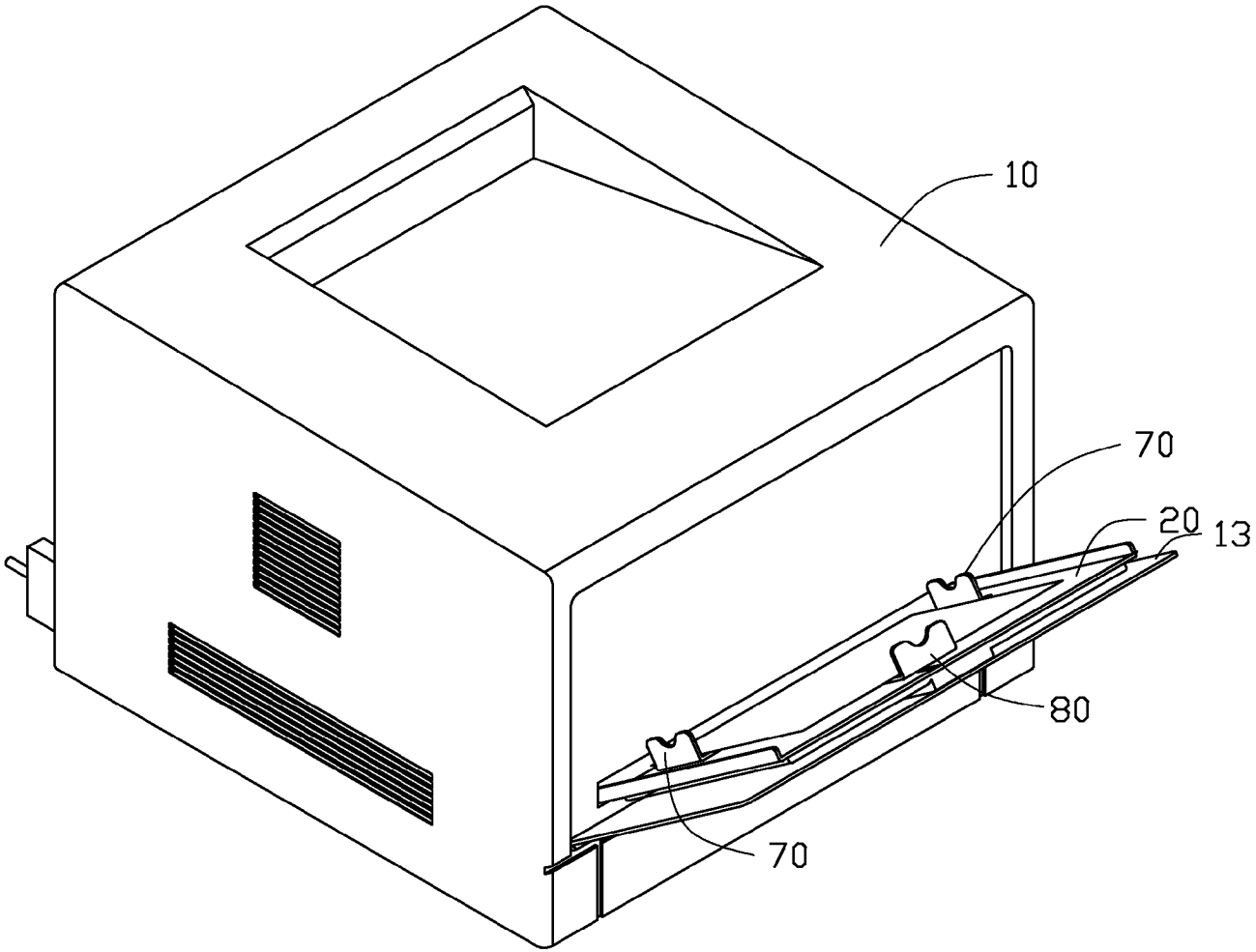
FIG. 7 is similar to FIG. 6, but showing another size paper positioned on the paper tray and the first and second sliding members in a second position.

Referring also to FIG. 7, if another paper having a second size is printed, the sensor detects the second size of the outputted paper and controls the driving gear member 30 to rotate. The first gear members 50 and the second gear member 60 are slid. The first sliding members 70 and the second sliding member 80 are thereby slid to reshape the first space to a second space to fit the second size of the outputted paper and cause the outputted paper to precisely stack in a neat orderly stack on the paper tray 20.

It is to be understood, however, that even though numerous characteristics and advantages have been set forth in the foregoing description of embodiments, together with details of the structures and functions of the embodiments, the disclosure is illustrative only and changes may be made in detail, especially in matters of shape, size, and arrangement of parts within the principles of the disclosure to the full extent indicated by the broad general meaning of the terms in which the appended claims are expressed.

What is claimed is:

1. A printer comprising:

a main body capable of printing and outputting paper; and a paper holding device secured to the main body, the paper holding device comprising:

a paper tray configured for receiving outputted paper and defining two first sliding slots and a second sliding slot, and a driving gear member located on the paper tray;

a connecting mechanism located on the paper tray and connected to the driving gear member, the connecting mechanism comprising two first gear members and a second gear member, a first sliding block and a first limiting block extending from each first gear member and slidably received into the first sliding slot, and a second sliding block and a second limiting block extending from the second gear member and slidably received in the second sliding slot; and a sliding mechanism located on the paper tray and connected to the connecting mechanism;

wherein the driving gear member controls the sliding mechanism by the connecting mechanism to shape a space to fit the size of the outputted paper.

2. The printer of claim 1, wherein the driving gear member and the connecting mechanism are located on a bottom surface of the paper tray, and the sliding mechanism is located on a top surface of the paper tray.

3. The printer of claim 1, wherein the paper holding device further comprises a cover secured to the paper tray , a recess is defined in the cover to encase the driving gear member.

4. The printer of claim 1, wherein the main body comprises a rear wall; and the rear wall defines an opening for outputting the paper; a supporting plate is attached to the main body below the opening; and the paper holding device is located on the supporting plate.

5. The printer of claim 1, wherein the sliding mechanism comprises two first sliding members and a second sliding member; and the two first sliding members are secured to the two first sliding member via the two first sliding slots, and the second sliding member is secured to the second sliding member via the second sliding slot.

6. The printer of claim 5, wherein the two first sliding slots extend in a first direction; the second sliding slot extends in a second direction; and the first direction is substantially perpendicular to the second direction.

7. The printer of claim 5, wherein the driving gear member comprises a top gear portion, a bottom gear portion, and a connecting portion located between the top gear portion and the bottom gear portion; a diameter of the connecting portion is greater than that of the top gear portion and the bottom gear portion; and the two first gear members mesh with the top gear member, and the second gear member mesh with the bottom gear member, so that the two first gear members are separated from the second gear member by the connecting portion.

8. The printer of claim 7, wherein the two first gear members are slid in opposite directions when the driving gear member is rotated; and the second gear member is slid in a direction perpendicular to the opposite directions when the driving gear member is rotated.

9. The printer of claim 1, wherein a flange is located on a bottom surface of the paper tray, along an edge of the second sliding slot, and the flange abuts the second gear member.

10. A printer comprising:

a main body capable of printing and outputting paper; and a paper holding device secured to the main body, the paper holding device comprising:

a paper tray configured for receiving outputted paper and defining two first sliding slots and a second sliding slot, a driving gear member located on the paper tray and capable of rotating;

a connecting mechanism attached to the paper tray, the connecting mechanism comprising two first gear members and a second gear member, the two first gear members and the second gear member meshing with the driving gear member, a first sliding block and a first limiting block extending from each first gear member, and a second sliding block and a second limiting block extending from the second gear member; and a sliding mechanism attached to the paper tray, the sliding mechanism comprising two first sliding members and a second sliding member;

wherein the first blocking slidably extends through the first sliding slot and secured to the first sliding member, the second blocking slidably extends through the second sliding slot and secured to the second sliding member, the driving gear member is rotated to slide the two first gear members and the second gear member to side the two first sliding members and the second sliding member on the paper tray.

11. The printer of claim 10, wherein the driving gear member and the connecting mechanism are located on a bottom surface of the paper tray, and the sliding mechanism is located on a top surface of the paper tray.

12. The printer of claim 10, wherein the paper holding device further comprises a cover secured to the paper tray, a recess is defined in the cover to encase the driving gear member.

13. The printer of claim 10, wherein the main body comprises a rear wall; the rear wall defines an opening for outputting the paper; a supporting plate is attached to the main body below the opening; and the paper holding device is located on the supporting plate.

14. The printer of claim 10, wherein the paper tray defines two first sliding slots and a second sliding slot; and the two first sliding members are secured to the two first gear members via the two first sliding slots, and the second sliding member is secured to the second gear member via the second sliding slot.

15. The printer of claim 10, wherein the driving gear member comprises a top gear portion, a bottom gear portion, and a connecting portion located between the top gear portion and the bottom gear portion; a diameter of the connecting portion is greater than that of the top gear portion and the bottom gear portion; and the two first gear members mesh with the top gear member, and the second gear member mesh with the bottom gear member, so that the two first gear members are separated from the second gear member by the connecting portion.

16. The printer of claim 14, wherein the two first gear members are slid in opposite directions when the driving gear member is rotated; and the second gear member is slid in a direction perpendicular to the opposite directions when the driving gear member is rotated.

17. The printer of claim 16, wherein a flange is located on a bottom surface of the paper tray, along an edge of the second sliding slot, and the flange abuts the second gear member.

18. A paper holding device comprising:

a paper tray configured for receiving outputted paper, a driving gear member located on the paper tray and capable of rotating, the driving gear member comprising a top ear portion, a bottom gear portion, and a connecting portion located between the top gear portion and the bottom gear portion, a diameter of the connecting portion is greater than that of the top gear portion and the bottom gear portion;

a connecting mechanism attached to the paper tray, the connecting mechanism comprising two first gear members and a second gear member, the two first gear members and the second gear member meshing with the driving gear member; and a sliding mechanism attached to the paper tray, the sliding mechanism comprising two first sliding member secured to two first gear members and the second sliding member secured to a second gear member;

wherein the two first gear members mesh with the top gear member, and the second gear member mesh with the bottom gear member, so that the two first gear members are separated from the second gear member by the connecting portion, the driving gear member is rotated to slide the two first and second gear members to side the two first and second sliding members on the paper tray.

19. The paper holding device of claim 18, wherein the paper tray defines two first sliding slots and a second sliding slot; and the two first sliding members are secured to the two first gear members via the two first sliding slots, and the second sliding member is secured to the second gear member via the second sliding slot.

20. The paper holding device of claim 19, wherein a flange is located on a bottom surface of the paper tray, along an edge of the second sliding slot, and the flange abuts the second gear member.

* * * * *